US008074544B2

(12) United States Patent
Nishino et al.

(10) Patent No.: US 8,074,544 B2
(45) Date of Patent: Dec. 13, 2011

(54) CYLINDRICAL GRINDING APPARATUS AND METHOD FOR GRINDING

(75) Inventors: Hidehiko Nishino, Nishishirakawa (JP); Yoshihiro Hirano, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 12/811,414

(22) PCT Filed: Jan. 21, 2009

(86) PCT No.: PCT/JP2009/000204

§ 371 (c)(1),
(2), (4) Date: Jul. 1, 2010

(87) PCT Pub. No.: WO2009/101761

PCT Pub. Date: Aug. 20, 2009

(65) Prior Publication Data

US 2010/0282036 A1 Nov. 11, 2010

(30) Foreign Application Priority Data

Feb. 15, 2008 (JP) ..... 2008-035045

(51) Int. Cl.
*B24B 1/00* (2006.01)
*B24B 5/04* (2006.01)

(52) U.S. Cl. ..... 82/122; 82/165

(58) Field of Classification Search ..... 82/117, 82/122, 150, 151, 165; 451/242, 246, 385, 451/411

See application file for complete search history.

(56) References Cited

U.S. PATENT DOCUMENTS

| | | | | | |
|---|---|---|---|---|---|
| 1,949,527 | A | * | 3/1934 | Briney | 29/898.054 |
| 2,004,649 | A | * | 6/1935 | Booth et al. | 451/52 |
| 2,059,895 | A | * | 11/1936 | Norton et al. | 451/244 |
| 2,154,326 | A | * | 4/1939 | Dorin | 82/122 |
| 2,442,635 | A | * | 6/1948 | Bennett | 451/395 |
| 2,693,066 | A | * | 11/1954 | Berstecher | 451/24 |
| 4,951,422 | A | * | 8/1990 | Ibe et al. | 451/5 |
| 5,511,913 | A | * | 4/1996 | Naumann | 409/131 |

FOREIGN PATENT DOCUMENTS

| | | |
|---|---|---|
| JP | U-63-166334 | 10/1988 |
| JP | A-2-131849 | 5/1990 |
| JP | A-275723 | 11/1990 |
| JP | U-6-63266 | 9/1994 |
| JP | A-8-155948 | 6/1996 |
| JP | A-2005-288562 | 10/2005 |

OTHER PUBLICATIONS

Feb. 24, 2009 International Search Report issued in corresponding International Patent Application No. PCT/JP2009/000204.

* cited by examiner

*Primary Examiner* — Will Fridie, Jr.
(74) *Attorney, Agent, or Firm* — Oliff & Berridge, PLC

(57) ABSTRACT

A cylindrical grinding apparatus grinding a side face of a cylindrical ingot, having a centering means of at least three rollers and an arm holding the rollers. The cylindrical ingot is placed on a table longitudinally, its end faces being held vertically with a pair of clamps. Afterward, the centering means moves backward and forward against the ingot horizontally to bring the rollers into pressure contact with the side face of the ingot while the ingot is rotated about a central axis with a rotation means, and thereafter the ingot is ground with the grinding wheel. The cylindrical grinding apparatus and the method for grinding enable improvement of grinding processing efficiency of the ingot.

8 Claims, 3 Drawing Sheets

(A)

(B)

CYLINDRICAL GRINDING APPARATUS AND METHOD FOR GRINDING

TECHNICAL FIELD

The present invention relates to a cylindrical grinding apparatus used in a step of cylindrical grinding of a single crystal ingot in fabrication of a semiconductor and a method for grinding using the apparatus.

BACKGROUND ART

A single crystal ingot produced by using the CZ method and the like has a cylindrical body portion and cone-shaped end portions (a top portion and a tail portion). These cone-shaped end portions are cut away by an inner diameter slicer, an outer diameter slicer, a band saw or the like in a step of cutting into a block so that the cylindrical body portion is separated from them. The body portion is further cut into a plurality of blocks as needed. Thereafter, each of the ingot blocks is sliced into many silicon wafers with a wire saw and the like after its outer circumferential surface is subjected to grinding processing so as to have a predetermined diameter.

A cylindrical grinding apparatus is the most general as a grinding apparatus for grinding the outer peripheral surface of a cylindrical ingot.

FIG. 4 shows a schematic view of an example of a conventionally general cylindrical grinding apparatus.

This cylindrical grinding apparatus 101 has clamps 102, 102' for holding an ingot 105, a rotation means 104 for driving to rotate the ingot 105, a grindstone 103 for grinding the ingot 105 and the like. The apparatus is constructed such that while rotation driving force is transmitted from the clamps 102, 102' to the ingot 105 to rotate the ingot about a central axis, the so-called traverse movement is made in such a manner that a rotating disklike grindstone 103 is fed toward the ingot 105 in the direction of a rotating axis of the grindstone and simultaneously in the direction of a rotating axis of clamps 102, 102' so that an outer circumferential surface of the ingot 105 is ground.

In the cylindrical grinding apparatus 101, end faces of the ingot 105 are held in a horizontal direction. That is, the ingot is held in such a manner that a rotating axis of the ingot 105 is aligned with the horizontal direction. As described above, the grindstone 103 is fed toward a side of the ingot 105 in the direction of a rotating axis of the grindstone 103 and simultaneously in the direction of the rotating axis of clamps 102, 102'. Therefore, in the case where the rotating axis of the ingot 105 is not aligned with the rotating axis of clamps 102, 102', the ingot cannot be ground to a cylindrical form and further an excessive grinding stock removal occurs. Thus, centering of the ingot is essential before grinding.

With regard to this centering, there is disclosed a cylindrical grinding apparatus in which sectional shapes at many points in the direction of a workpiece axis are measured, a polishing center is calculated by operation based on the measurement result, positional difference between the calculated polishing center and a rotation center of the workpiece is adjusted with a driving portion adjusting a workpiece position (See Japanese Patent Laid-open (Kokai) No. H2-131849).

There is also disclosed an external diameter grinder for grinding a workpiece with holding both end faces of the workpiece by a fix rod, the grinder which is constructed to equalize a radius of the workpiece with a vertical distance from an extensional center line of the fix rod to a workpiece contact portion of a workpiece placement portion in condition where the workpiece is placed on the workpiece placement portion (See Japanese Utility Model Laid-open (Kokai) No. H6-63266).

However, even though the foregoing grinding apparatus is used, for the purpose of performing the centering precisely, a method of finally hitting the workpiece with a plastic hammer and the like by a skilled worker and of performing a final visual centering step is adopted in the present condition. The centering can be thus performed precisely, whereas much time is needed for steps before the start of grinding the ingot. This contributes grinding processing efficiency to lower.

DISCLOSURE OF INVENTION

In view of the above-explained problems, it is an object of the present invention to provide a cylindrical grinding apparatus and a method for grinding that enable the grinding processing efficiency of the ingot to be improved by reducing time required for steps from the placement of the ingot onto a table of the cylindrical grinding apparatus to the end of the precise centering in the grinding processing of the side face of the cylindrical ingot.

To achieve this object, the present invention provides a cylindrical grinding apparatus having at least a table on which a cylindrical ingot is placed in a longitudinal direction, a pair of clamps for holding both end faces of the ingot in a vertical direction, a rotation means for driving to rotate the ingot about a central axis and a grinding wheel movable in the direction of a rotating axis of the rotation means, and grinding a side face of the cylindrical ingot, the apparatus comprising a centering means composed of at least three rollers and an arm for holding the rollers, the centering means being capable of moving backward and forward against the ingot in a horizontal direction to bring the rollers into pressure contact with the ingot, wherein the cylindrical ingot is placed on the table in a longitudinal direction, both end faces of the ingot are held vertically with the pair of clamps after moving the ingot placed in a longitudinal direction onto one of the clamps from the table, the centering means moves backward and forward against the ingot in a horizontal direction to bring the rollers into pressure contact with the side face of the ingot while the ingot is rotated about the central axis with the rotation means so that the rotating axis of the rotation means is aligned with the central axis of the ingot, and thereafter the ingot is ground with the grinding wheel.

In this manner, the cylindrical grinding apparatus according to the present invention comprises the centering means composed of at least three rollers and the arm for holding the rollers, the centering means being capable of moving backward and forward against the ingot in a horizontal direction to bring the rollers into pressure contact with the ingot, wherein the cylindrical ingot is placed on the table in a longitudinal direction, both end faces of the ingot are held vertically with the pair of clamps after moving the ingot placed in a longitudinal direction onto one of the clamps from the table, the centering means moves backward and forward against the ingot in a horizontal direction to bring the rollers into pressure contact with the side face of the ingot while the ingot is rotated about the central axis with the rotation means so that the rotating axis of the rotation means is aligned with the central axis of the ingot, and thereafter the ingot is ground with the grinding wheel. The apparatus can therefore perform the centering without a skilled worker mechanically, reduce time required for the steps from the placement of the ingot onto the table of the cylindrical grinding apparatus to the end of the precise centering, and thereby improve the grinding processing efficiency of the ingot.

In this case, the table preferably has a U-shaped notch.

In this manner, when the table has the U-shaped notch, the ingot can be moved onto or from the clamp while interference of the clamp with the table is avoided with a simple structure, it can be composed at low cost, and process time can be reduced. Thereby, the time required for the steps from the placement of the ingot onto the table of the cylindrical grinding apparatus to the end of the precise centering can be more reduced, and the grinding processing efficiency of the ingot can be more improved.

In this case, the centering means can include a pair of centering members composed of a Y-shaped arm provided with two rollers, the centering members being symmetrically arranged respectively.

In this manner, when the centering means includes the pair of centering members composed of a Y-shaped arm provided with two rollers, the centering members being symmetrically arranged respectively, the apparatus can perform the centering precisely with a simple structure.

Furthermore, the present invention provides a method for grinding an ingot by using a cylindrical grinding apparatus grinding a side face of a cylindrical ingot, the method comprising the steps of: placing the cylindrical ingot on a table in a longitudinal direction; holding both end faces of the ingot vertically with clamps rotatable about a rotating axis after moving the ingot placed in a longitudinal direction onto one of the clamps from the table; moving a centering means backward and forward against the ingot in a horizontal direction, the centering means being composed of at least three rollers and an arm for holding the rollers, and bringing the rollers into pressure contact with the side face of the ingot while rotating the ingot held with the clamps about the central axis so that the rotating axis of the clamps is aligned with the central axis of the ingot; and thereafter grinding the side face of the ingot by bringing a grinding wheel into contact with the side face of the ingot and feeding the grinding wheel in a vertical direction.

In this manner, by the method of placing the cylindrical ingot on a table in a longitudinal direction; holding both end faces of the ingot vertically with clamps rotatable about a rotating axis after moving the ingot placed in a longitudinal direction onto one of the clamps from the table; moving a centering means backward and forward against the ingot in a horizontal direction, the centering means being composed of at least three rollers and an arm for holding the rollers, and bringing the rollers into pressure contact with the side face of the ingot while rotating the ingot held with the clamps about the central axis so that the rotating axis of the clamps is aligned with the central axis of the ingot; and thereafter grinding the side face of the ingot by bringing a grinding wheel into contact with the side face of the ingot and feeding the grinding wheel in a vertical direction, the centering can be performed without a skilled worker mechanically, the time required for the steps from the placement of the ingot onto the table of the cylindrical grinding apparatus to the end of the precise centering can be reduced, and thereby the grinding processing efficiency of the ingot can be improved.

In this case, the table is preferably provided with a U-shaped notch.

In this manner, when the table is provided with the U-shaped notch, the ingot can be moved onto or from the clamp while interference of the clamp with the table is avoided with a simple structure, it can be composed at low cost, and the process time can be reduced. Thereby, the time required for the steps from the placement of the ingot onto the table of the cylindrical grinding apparatus to the end of the precise centering can be more reduced, and the grinding processing efficiency of the ingot can be more improved.

In this case, the centering means can be used which includes a pair of centering members composed of a Y-shaped arm provided with two rollers, the centering members being symmetrically arranged respectively.

In this manner, when the centering means is used which includes the pair of centering members composed of the Y-shaped arm provided with two rollers, the centering members being symmetrically arranged respectively, the centering can be performed precisely with a simple structure.

In the cylindrical grinding apparatus according to the present invention, the cylindrical ingot is placed on the table in a longitudinal direction, both end faces of the ingot are held vertically with the pair of clamps after moving the ingot placed in a longitudinal direction onto one of the clamps from the table, the centering means moves backward and forward against the ingot in a horizontal direction to bring the rollers into pressure contact with the side face of the ingot while the ingot is rotated about the central axis with the rotation means so that the rotating axis of the rotation means is aligned with a central axis of the ingot, and thereafter the ingot is ground with the grinding wheel. Therefore, the centering can be performed without a skilled worker mechanically, the time required for the steps from the placement of the ingot onto the table of the cylindrical grinding apparatus to the end of precise centering can be reduced, and thereby the grinding processing efficiency of the ingot can be improved.

BEST MODE FOR CARRYING OUT THE INVENTION

Hereinafter, an embodiment according to the present invention will be explained, but the present invention is not restricted thereto.

In conventional grinding processing of the side face of the cylindrical ingot, steps before the start of grinding the ingot require a manual operation by a worker. In particular, as a centering operation of the ingot, the method of finally hitting the ingot with a plastic hammer by a skilled worker and of performing the final visual centering step is adopted in the present condition. Moreover, since the ingot is held such that its rotating axis becomes horizontal in a conventionally general cylindrical grinding apparatus, the centering operation requires much hard labor. In the case of working a larger diameter of the ingot in recent years, the labor is remarkable. Although the centering can be thus performed precisely by a skilled worker, much time is needed for the steps before the start of grinding the ingot as described above. This causes the grinding processing efficiency to lower.

In view of this, the present inventor repeatedly keenly conducted studies to perform the centering without a skilled worker mechanically and to reduce the time required for the steps before the start of grinding the ingot. As a result, the present inventor found that the centering can be efficiently performed without a skilled worker by holding the ingot vertically, and can be performed precisely and mechanically in a short time further by bringing the centering means having a plurality of the rollers into pressure contact with the ingot while the ingot is rotated about the central axis.

That is, the cylindrical grinding apparatus according to the present invention comprises the centering means composed of at least three rollers and the arm for holding the rollers, the centering means being capable of moving backward and forward against the ingot in a horizontal direction to bring the rollers into pressure contact with the ingot, in which the cylindrical ingot is placed on the table in a longitudinal direction, both end faces of the ingot are held vertically with the pair of clamps after moving the ingot placed in a longitudinal direction onto one of the clamps from the table, the centering means moves backward and forward against the ingot in a horizontal direction to bring the rollers into pressure contact with the side face of the ingot while the ingot is rotated about the central axis with the rotation means so that the rotating axis of the rotation means is aligned with a central axis of the ingot, and thereafter the ingot is ground with the grinding wheel. The apparatus can therefore perform the centering without a skilled worker mechanically, reduce the time required for the steps from the placement of the ingot onto the table of the cylindrical grinding apparatus to the end of precise centering, and thereby improve the grinding processing efficiency of the ingot.

Figure 1:
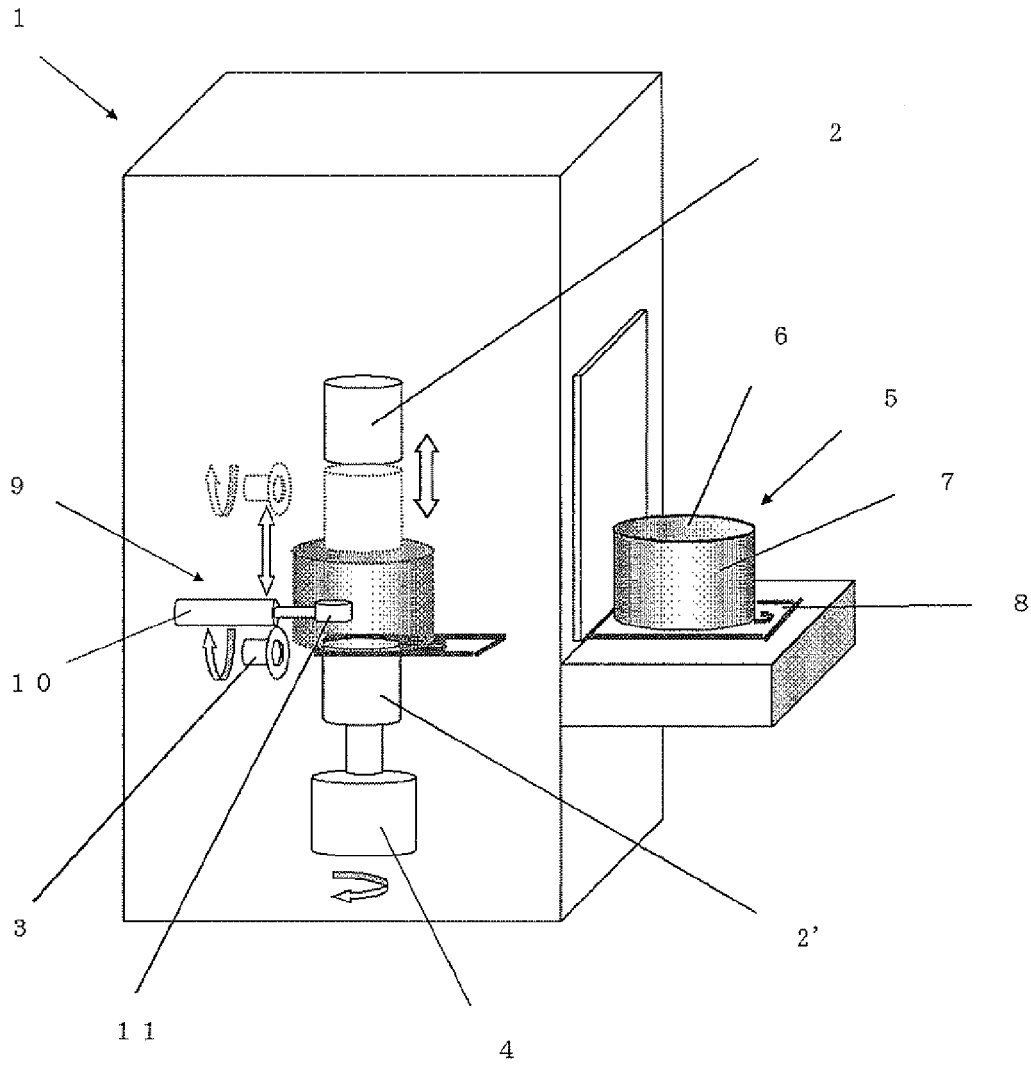
FIG. 1 is a schematic view showing an example of the cylindrical grinding apparatus according to the present invention.

FIG. 1 is a schematic view showing an example of the cylindrical grinding apparatus according to the present invention.

As shown in FIG. 1, the cylindrical grinding apparatus 1 is provided with the pair of clamps 2, 2' for holding both end faces 6 of the cylindrical ingot 5 to be ground, the rotation means 4 for driving to rotate the ingot 5 about the central axis and the grinding wheel 3 that is a grindstone for grinding the side face 7 of the ingot 5 and is rotatable about the rotating axis. The apparatus brings the grinding wheel 3 into contact with the side face 7 of the ingot and moves the grinding wheel 3 upward and downward along the side face 7 of the ingot to grind the side face of the ingot 5.

The cylindrical grinding apparatus 1 according to the present invention has the table 8 on which the ingot 5 is placed in a longitudinal direction. The ingot 5 placed on the table 8 in a longitudinal direction is transported onto the clamp 2' by moving the table 8. At least one of the pair of the clamps 2, 2' can be moved upward and downward in a vertical direction, and both end faces of the ingot 5 can be held vertically with the clamps 2, 2'.

The holding of the ingot as described above can be performed with pressing force between the clamps, for example, with a hydraulic cylinder, and intensity of the pressing force can be adjusted to a desired value.

Moreover, the clamps 2, 2' are rotatable about the rotating axis, rotation driving force is transmitted from the rotation means 4 to the clamp 2', and the ingot 5 held with the clamps 2, 2' can be rotated about the central axis.

Furthermore, the grinding wheel 3 is rotatable about its axis at a high speed. The grinding wheel 3 is movable backward and forward in the direction of the axis, and is brought into contact with the side face 7 of the ingot to grind by moving forward. The grinding wheel 3 is also movable along the side face 7 of the ingot, that is, in a vertical direction and can thus perform a traverse grinding. The apparatus makes the traverse movement of the grinding wheel 3, as described above, to grind the side face of the ingot 5 while the ingot 5 is rotated about the central axis with the rotation means 4.

Here, the pressing force between the clamps 2, 2' holding the ingot 5 at the time of the grinding can be, for example, 10000 to 20000 N so as not to generate the positional difference and the like of the ingot 5 during the grinding. However, these conditions are not restricted thereto as long as the pressing force does not cause the positional difference and the like due to movement of the ingot 5 between the clamps 2, 2' during the grinding.

Moreover, a rotating speed of the rotation of the ingot 5 about the central axis at the time of the grinding can be, for example, 5 to 20 rpm. However, these conditions are also not restricted thereto, and may be appropriately determined according to conditions such as an outer diameter of the ingot and the like.

The cylindrical grinding apparatus 1 according to the present invention has the centering means 9 for performing the centering of the ingot 5 placed on the clamps 2, 2'. The centering means 9 is composed of at least the three rollers 11 and the arm 10 for holding the rollers 11. The centering means 9 is capable of moving backward and forward against the ingot 5 in a horizontal direction to bring the rollers 11 into pressure contact with the ingot.

Incidentally, since the cylindrical grinding apparatus 1 according to the present invention holds the ingot 5 vertically as described above, the pressing force between the clamps 2, 2' during the centering can be lowered in comparison with the conventional cylindrical grinding apparatus in which end faces of the ingot are held in a horizontal direction, and thereby the centering can be efficiently performed. With the centering means 9, the apparatus moves the centering means 9 backward and forward against the ingot 5 in a horizontal direction to bring the rollers 11 into pressure contact with the ingot 5 while the ingot 5 is rotated about the central axis with the rotation means 4, and thereby can perform the step of the centering so as to align the rotating axis of the rotation means 4 (the rotating axis of the clamps) with the central axis of the ingot 5 without a skilled worker mechanically and precisely in a short time.

The cylindrical grinding apparatus 1 according to the present invention can thus improve the grinding processing efficiency.

Here, the number of the rollers 11 is not restricted as long as it is 3 or more, but for example it can be 4 to 6.

Moreover, the pressing force between the clamps at the time of the centering can be, for example, 2000 to 8000N. In this way, the ingot 5 that is brought into pressure contact with the rollers 11 of the centering means 9 can move to a centering position between the clamps 2, 2'. However, these conditions are not restricted thereto as long as the ingot 5 can move to the centering position between the clamps 2, 2' under the pressing force, and may be appropriately determined according to an outer diameter of the ingot and the like.

Moreover, the rotating speed of the rotation of the ingot 5 about the central axis at the time of the centering can be, for example, 1 to 5 rpm. However, these conditions are also not restricted thereto, and may be appropriately determined so as to perform the centering efficiently according to conditions such as an outer diameter of the ingot and the like.

Figure 2:
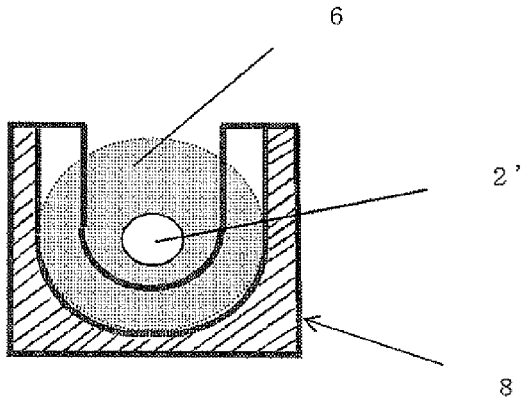
FIG. 2 are schematic views showing an example of the table that can be used in the cylindrical grinding apparatus according to the present invention, wherein (A) shows a bottom view of the table, (B) shows a schematic view of a condition where the table descends after the ingot is moved onto the clamp by the table.
Figure 2:
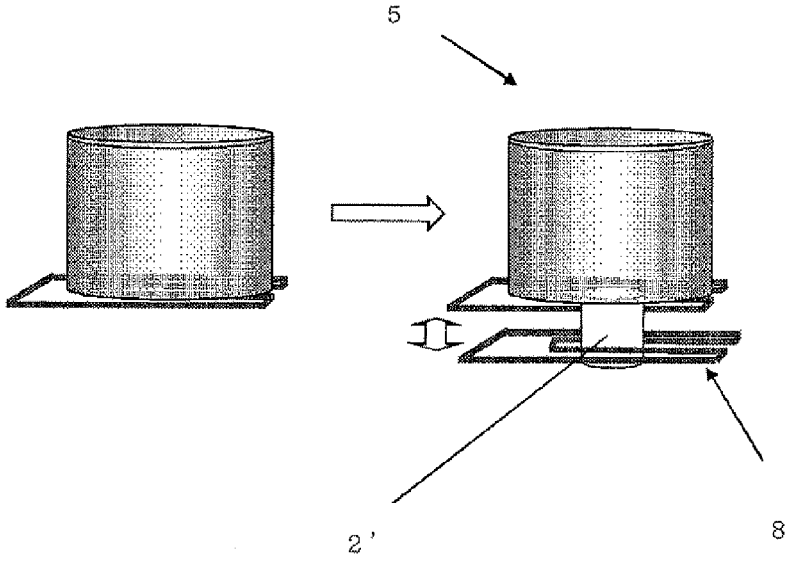

In this case, as shown in FIG. 2(A), the table preferably has the U-shaped notch.

As described above, when the table has the U-shaped notch, as shown in FIG. 2(B), the ingot 5 can be easily moved onto the clamps 2' in such a manner that the table 8 on which the ingot 5 is placed descends from above the clamps 2' and thereafter moves backward, and thereby the process time can be reduced. Thereby, the time required for the steps from the placement of the ingot 5 onto the table 8 of the cylindrical grinding apparatus 1 to the end of precise centering can be more reduced, the grinding processing efficiency of the ingot can be more improved, and the apparatus can be composed at low cost.

Here, resin, which gives an indication of a diameter of the ingot, can be adhered to a surface of the table 8 (a portion of oblique lines in FIG. 2(A)). In this way, the resin can be an indication of the position at which the ingot 5 is placed on the table 8 in a longitudinal direction, and therefore the ingot 5 can be prevented from being placed on the table 8 with a great positional difference from an axis, that is, it serves convenience in the following centering step.

In this case, the centering means 9 can include the pair of centering members composed of the Y-shaped arm provided with two rollers, the centering members being symmetrically arranged respectively.

Figure 3:
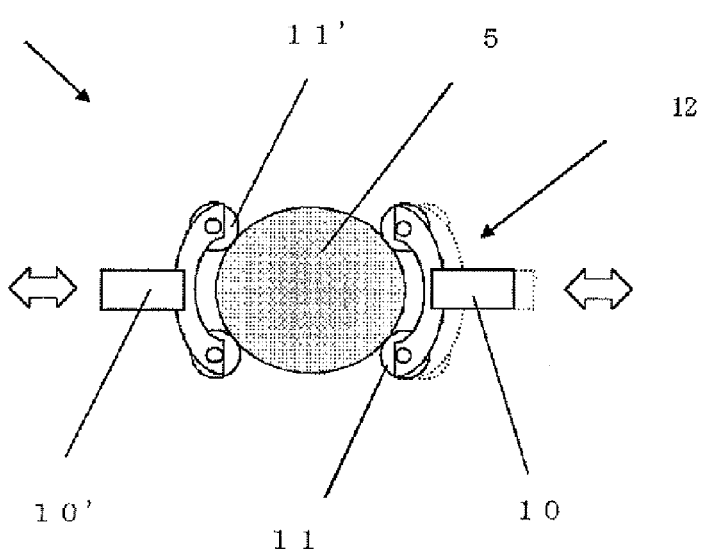
FIG. 3 is a schematic view showing an example of the centering means that can be used in the cylindrical grinding apparatus according to the present invention.

FIG. 3 shows an example of the centering means that can be used in the cylindrical grinding apparatus according to the present invention.

As shown in FIG. 3, the two rollers 11, 11' are provided at the ends of the Y-shaped arm 10, 10'. The centering members 12 are symmetrically arranged respectively. Each of the members can make a forward movement and a backward movement, for example, with an air cylinder and the like. The ingot 5 can be brought into pressure contact with the rollers 11, 11' by moving the centering members 12 forward toward the ingot 5.

As described above, when the centering means 9 includes the pair of centering members 12 composed of the Y-shaped arm provided with the two rollers, the centering members being symmetrically arranged respectively, the apparatus can perform the centering precisely with a simple structure.

Next, the method for grinding an ingot according to the present invention will be explained.

In the method for grinding an ingot according to the present invention, first, the cylindrical ingot 5 is placed on the table 8 in a longitudinal direction with the cylindrical grinding apparatus 1 as shown in FIG. 1. Then, the ingot 5 is moved onto the clamp 2' by moving the table 8 to above the clamp 2' and thereafter causing the table 8 to descend, and both end faces 6 of the ingot 5 is held vertically with the clamps 2, 2'.

Here, the ingot 5 is moved onto the clamp 2' by moving the table in an example of the cylindrical grinding apparatus 1 shown in FIG. 1, but it may be constructed so as to move the clamp 2'.

Next, the centering means 9, which is composed of at least the three rollers 11 and the arm 10 for holding the rollers 11, is moved backward and forward against the ingot 5 in a horizontal direction and bringing the rollers 11 into pressure contact with the side face 7 of the ingot 5 while the ingot 5 held with the clamps 2, 2' about the central axis is rotated so that the centering is performed so as to align the rotating axis of the clamps 2, 2' with the central axis of the ingot 5.

Here, the number of the rollers 11 is not restricted as long as it is 3 or more, but for example the centering means having 4 to 6 rollers can be used.

Moreover, the pressing force between the clamps 2, 2' at the time of the centering can be, for example, 2000 to 8000 N. In this way, the ingot 5 that is brought into pressure contact with the rollers 11 of the centering means 9 can move to the centering position between the clamps 2, 2'. However, these conditions are not restricted thereto as long as the ingot 5 can move to the centering position between the clamps 2, 2' under the pressing force, and may be appropriately determined according to an outer diameter of the ingot and the like.

Moreover, the rotating speed of the rotation of the ingot 5 about the central axis at the time of the centering can be, for example, 1 to 5 rpm. However, these conditions are also not restricted thereto, and may be appropriately determined so as to perform the centering efficiently according to conditions such as an outer diameter of the ingot and the like.

Moreover, the centering can be finished at the point when a predetermined time elapses from the start of the centering. Here, the predetermined time is not restricted as long as the centering can be performed precisely during the time, and can be, for example, 30 seconds to 2 minutes.

The centering means 9 that is brought into pressure contact with the ingot is moved backward thereafter. The pressing force between the clamps 2, 2' holding the ingot 5 is increased so as not to generate the positional difference and the like of the ingot 5 during the grinding, and the ingot 5 is fixed. The side face of the ingot 5 is ground by bringing the grinding wheel 3 into contact with the side face 7 of the ingot and feeding the grinding wheel 3 in a vertical direction while the ingot 5 is rotated about the central axis.

Here, the pressing force between the clamps 2, 2' at the time of the grinding can be, for example, 10000 to 20000 N. In this way, the positional difference and the like due to the movement of the ingot 5 between the clamps 2, 2' can be prevented from being generated during the grinding. However, these conditions are not also restricted thereto as long as the pressing force does not cause the positional difference and the like due to the movement of the ingot 5 between the clamps 2, 2' during the grinding.

Moreover, the rotating speed of the rotation of the ingot 5 about the central axis at the time of the grinding can be, for example, 5 to 20 rpm. However, these conditions are not restricted thereto, and may be appropriately determined according to conditions such as an outer diameter of the ingot and the like.

In this case, as shown in FIG. 2(A), the table 8 is preferably provide with the U-shaped notch.

As described above, when the table 8 is provided with the U-shaped notch, as shown in FIG. 2(B), the ingot 5 can be easily moved onto the clamps 2' without the interference of the clamp 2' and the table 8 with one another in such a manner that the table 8 on which the ingot 5 is placed descends from above the clamps 2', and thereby the process time can be reduced. Thereby, the time required for the steps from the placement of the ingot 5 onto the table 8 of the cylindrical grinding apparatus 1 to the end of precise centering can be more reduced, the grinding processing efficiency of the ingot can be more improved, and the apparatus can be composed at low cost.

In this case, the centering means 9 can be used which includes the pair of centering members 12 composed of the Y-shaped arm provided with the two rollers as shown in FIG. 3, the centering members being symmetrically arranged respectively.

As described above, when the centering means 9 is used which includes the pair of centering members composed of the Y-shaped arm provided with the two rollers, the centering members being symmetrically arranged respectively, the centering can be performed precisely with a simple structure.

Here, the centering means 9 can make a forward movement and a backward movement, for example, with an air cylinder and the like, and in this case supply pressure can be 0.3 to 0.6 MPa. However, these conditions are not restricted thereto, and may be appropriately determined according to an outer diameter of the ingot to be ground, a size of the centering means to be used and the like.

As explained above, in the method for grinding an ingot according to the present invention, the cylindrical ingot is placed on the table in a longitudinal direction, both end faces of the ingot are held vertically with the clamps rotatable about the rotating axis after moving the ingot placed in a longitudinal direction onto one of the clamps from the table, the centering means, which is composed of at least the three rollers 11 and the arm 10 for holding the rollers 11, is moved backward and forward against the ingot in a horizontal direction to bring the rollers into pressure contact with the side face of the ingot while the ingot held with the clamps is rotated about the central axis so that the rotating axis of the rotation means is aligned with the central axis of the ingot, and thereafter the side face of the ingot is ground by bringing the grinding wheel into contact with the side face of the ingot and feeding the grinding wheel in a vertical direction. Therefore, the centering can be performed without a skilled worker mechanically after placing the ingot on the table of the cylindrical grinding apparatus, the time required for the steps to the end of precise centering can be reduced, and thereby the grinding processing efficiency of the ingot can be improved.

Hereinafter, the present invention will be explained in more detail based on Example, but the present invention is not restricted thereto.

EXAMPLE

One block of a silicon ingot having a diameter of 300 mm was ground with the cylindrical grinding apparatus as shown in FIG. 1, and precision of the centering and grinding time were measured. The table having the U-shaped notch as shown in FIG. 2(A) was used. The centering means was used which includes the pair of centering members composed of the Y-shaped arm provided with the two rollers, the centering members being symmetrically arranged respectively. The centering means made a forward and backward movement with the air cylinder and was brought into pressure contact with the ingot by supply pressure of 0.5 MPa. In the centering step, the pressing force between the clamps was 5000 N and the ingot was rotated about the central axis at a rotating speed of 3 rpm. The predetermined time to the end of the centering was set at 1 minute.

Moreover, the pressing force between the clamps was changed into 15000 N after the end of the centering so that the ingot was fixed between the clamps, and the ingot was ground while the ingot was rotated about the central axis at a rotating speed of 10 rpm.

As a result, the centering was able to be performed with precision of ±1 mm, and the result was able to be high precision equal to the later-explained Comparative Example. The time required for the steps to the end of the grinding was approximately 51 minutes. It was revealed that the grinding processing efficiency was improved 1.6 times in comparison with approximately 80 minutes, which was the result of Comparative Example.

Accordingly, it was able to confirm that the method for grinding an ingot by using the cylindrical grinding apparatus according to the present invention enables the time required for the steps from the placement of the ingot onto the table of the cylindrical grinding apparatus to the end of the precise centering to be reduced and enables the grinding processing efficiency of the ingot to be improved.

COMPARATIVE EXAMPLE

Figure 4:
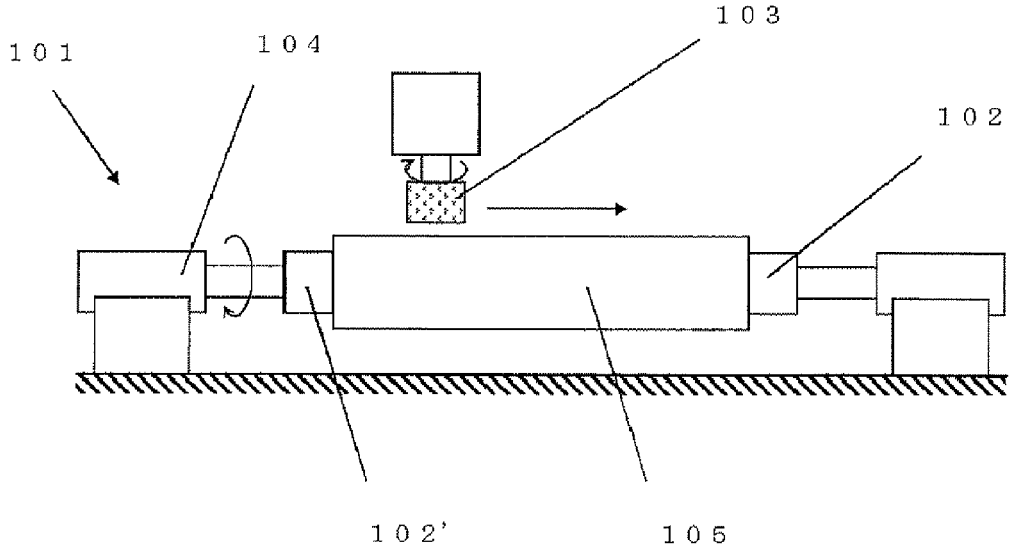
FIG. 4 is a schematic view showing an example of a conventional cylindrical grinding apparatus.

The centering of one block of a silicon ingot having the same conditions as Example was performed by a skilled worker with the conventional cylindrical grinding apparatus as shown in FIG. 4, thereafter the block was ground, and the same evaluation as Example 1 was made.

As a result, the centering was able to be precisely performed with precision of ±1 mm, whereas the time required for the steps from the placement of the ingot on the apparatus to the end of the centering was approximately 30 minutes, and the time required for the steps to the end of grinding was approximately 80 minutes.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A cylindrical grinding apparatus having at least a table on which a cylindrical ingot is placed in a longitudinal direction, a pair of clamps for holding both end faces of the ingot in a vertical direction, a rotation means for driving to rotate the ingot about a central axis and a grinding wheel movable in the direction of a rotating axis of the rotation means, and grinding a side face of the cylindrical ingot, the apparatus comprising a centering means composed of at least three rollers and an arm for holding the rollers, the centering means being capable of moving backward and forward against the ingot in a horizontal direction to bring the rollers into pressure contact with the ingot, wherein the cylindrical ingot is placed on the table in a longitudinal direction, both end faces of the ingot are held vertically with the pair of clamps after moving the ingot placed in a longitudinal direction onto one of the clamps from the table, the centering means moves backward and forward against the ingot in a horizontal direction to bring the rollers into pressure contact with the side face of the ingot while the ingot is rotated about the central axis with the rotation means so that the rotating axis of the rotation means is aligned with the central axis of the ingot, and thereafter the ingot is ground with the grinding wheel.

2. The cylindrical grinding apparatus according to claim 1, wherein the table has a U-shaped notch.

3. The cylindrical grinding apparatus according to claim 1, wherein the centering means includes a pair of centering members composed of a Y-shaped arm provided with two rollers, the centering members being symmetrically arranged respectively.

4. A method for grinding an ingot by using a cylindrical grinding apparatus grinding a side face of a cylindrical ingot, the method comprising the steps of:

placing the cylindrical ingot on a table in a longitudinal direction;

holding both end faces of the ingot vertically with clamps rotatable about a rotating axis after moving the ingot placed in a longitudinal direction onto one of the clamps from the table;

moving a centering means backward and forward against the ingot in a horizontal direction, the centering means being composed of at least three rollers and an arm for holding the rollers, and bringing the rollers into pressure contact with the side face of the ingot while rotating the ingot held with the clamps about a central axis so that the rotating axis of the clamps is aligned with the central axis of the ingot; and thereafter grinding the side face of the ingot by bringing a grinding wheel into contact with the side face of the ingot and feeding the grinding wheel in a vertical direction.

5. The method for grinding an ingot according to claim 4, wherein the table is provided with a U-shaped notch.

6. The method for grinding an ingot according to claim 4, wherein the centering means is used which includes a pair of centering members composed of a Y-shaped arm provided with two rollers, the centering members being symmetrically arranged respectively.

7. The cylindrical grinding apparatus according to claim 2, wherein the centering means includes a pair of centering members composed of a Y-shaped arm provided with two rollers, the centering members being symmetrically arranged respectively.

8. The method for grinding an ingot according to claim 5, wherein the centering means is used which includes a pair of centering members composed of a Y-shaped arm provided with two rollers, the centering members being symmetrically arranged respectively.

* * * * *